US006343887B1

(12) United States Patent
Dumler et al.

(10) Patent No.: US 6,343,887 B1
(45) Date of Patent: Feb. 5, 2002

(54) HAIR COLORING OR COSMETIC UNIT, IN PARTICULAR MASCARA UNIT

(75) Inventors: Norbert Dumler, Ansbach; Werner Fischer, Burk, both of (DE)

(73) Assignee: Georg Karl Geka-Brush GmbH, Bechhofen-Waisendorf (DE)

( * ) Notice: Subject to any disclaimer, the term of this patent is extended or adjusted under 35 U.S.C. 154(b) by 0 days.

(21) Appl. No.: 09/419,068

(22) Filed: Oct. 15, 1999

(30) Foreign Application Priority Data

Oct. 21, 1998 (DE) ..... 198 48 471

(51) Int. Cl.[7] ..... B43H 11/00

(52) U.S. Cl. ..... 401/129; 401/16; 401/126; 401/122

(58) Field of Search ..... 401/121, 122, 401/126, 127, 129, 119, 118, 123, 124, 16, 17, 29, 128, 130

(56) References Cited

U.S. PATENT DOCUMENTS

| | | | | | |
|---|---|---|---|---|---|
| 2,983,946 | A | * | 5/1961 | Edelstone et al. | 401/121 |
| 3,662,769 | A | * | 5/1972 | Vasas et al. | 401/122 |
| 3,763,870 | A | | 10/1973 | Montgomery et al. | |
| 4,761,088 | A | * | 8/1988 | Zubek | 401/122 |
| 5,316,399 | A | * | 5/1994 | Joulia | 401/126 |
| 6,026,823 | A | * | 2/2000 | Gueret | 401/126 |

FOREIGN PATENT DOCUMENTS

| | | |
|---|---|---|
| AT | 237807 | 1/1965 |
| DE | 3206801 | 9/1982 |
| DE | 4405335 | 8/1995 |
| DE | 19744181 | 4/1999 |

* cited by examiner

*Primary Examiner*—David J. Walczak
(74) *Attorney, Agent, or Firm*—Browdy and Neimark

(57) ABSTRACT

In a hair coloring or cosmetic unit, in particular mascara unit, comprising a receptacle for liquid take-up, which has a basic body and a neck of tapered diameter as compared to the basic body, and a closing cap to be placed on the neck, a rod with an applicator being fixable on the inside of the closing cap, and a stripper being provided in the vicinity of the neck for the applicator to be stripped upon withdrawal from the receptacle, it is provided that the applicator is connectable to the rod or the rod to the closing cap by the user, after the user has selected a preferred applicator or rod from a plurality of available samples thereof, and that the filled receptacle comprises a special closing and sealing device without a rod or an applicator.

10 Claims, 3 Drawing Sheets

HAIR COLORING OR COSMETIC UNIT, IN PARTICULAR MASCARA UNIT

BACKGROUND OF THE INVENTION

1. Field of the Invention

The invention relates to a hair coloring or cosmetic unit, in particular a mascara unit, comprising a receptacle for liquid take-up, which has a basic body and a neck of tapered diameter as compared to the basic body, and a closing cap to be placed on the neck, a rod with an applicator being fixable on the inside of the closing cap, and a stripper being provided in the vicinity of the neck, stripping the applicator upon withdrawal from the receptacle.

2. Background Art

Hair coloring or cosmetic units of the generic type, in particular mascara units, come in numerous designs which are published for instance in DE 44 05 335 A1, DE 197 44 181.5° A1 and U.S. Ser. No. 09/350,161.

Usually, brushes are provided as applicators in these hair coloring or cosmetic units, in particular mascara units, numerous modifications of these brushes being known for the transfer properties of mascara to be optimized during transport from the receptacle on to the lashes of the user and for the combing properties during application to be optimized. However, a fundamental drawback of such hair coloring or cosmetic units, in particular mascara units, resides in that the user can obtain a certain mascara for example of a preferred producer only along with a certain mascara brush or applicator, there being a variety of hair coloring or cosmetic units, in particular mascara units, which may have varying brushes, without however the possibility of individual selection of the brush or applicator for a certain mascara.

SUMMARY OF THE INVENTION

It is an object of the invention to embody a hair coloring or cosmetic unit, in particular mascara unit, of the type mentioned at the outset so that the user is able to use an applicator out of a variety of applicators which complies with the user's special preferences, habits of application and structure of lashes.

According to the invention, this object is attained by the applicator being connectable to the rod or the rod to the closing cap by the user after she has selected a preferred sample from a plurality of available applicators or rods.

The prior art teaches to attach a plastic member to the end of the rod of a mascara brush and to snap-engage it in the closing cap during the assembly at works of the hair coloring and cosmetic unit, in particular mascara unit, after which mascara is filled into the receptacle by the same or another producer and the receptacle is completed by the cap being closed, constituting a finished hair coloring or cosmetic unit, in particular mascara unit.

By contrast, the solution according to the invention provides that such a possibility of connection is ensured, that the user purchases for instance an assortment of varying mascara brushes and carries out experiments. In this regard, it is of special advantage that the applicator is connectable to the rod or the rod is connectable to the closing cap by locking engagement which is favorably releasable. Then the user may exchange the applicator as she pleases.

By alternative it can also be provided that the user is offered an assortment of mascara brushes for selection, that she selects a brush and connects same possibly non-releasably to the closing cap.

This offers entirely new possibilities, it being no longer necessary to orient the design and the properties of these applicators on the supposed wishes of the average user; by contrast, a wide range of mascara brushes can be offered so that the user, to her own taste, may select for instance brushes that have especially soft or very hard, very thick, regular or helical bristles.

In keeping with another preferred embodiment, it is provided that locking engagement of the rod and cap takes place within the closing cap or at the lower edge of the closing cap.

In this embodiment, a locking sleeve with an internally encircling locking groove extends preferably from a cover section of the closing cap in the direction towards the inside of the receptacle, it being possible to snapengage a locking bead of the rod in the locking groove. Consequently, simplicity of construction is accompanied with the possibility of very easy and rapid connection of high flexural strength.

By advantage, the locking bead is formed on a locking section that is tapered as compared to the diameter of the rod, constituting a stop collar for the locking sleeve.

The locking sleeve may be slit laterally for the required snap-in flexibility to be obtained.

By advantage, a flat handling section extends from the cover section centrically away from the inside of the receptacle, i.e. on the upper side of the closing cap. In the way of a fly nut, such a flat handling section enables high turning moments to be transmitted and facilitates opening even if the cap is stuck especially tightly because of rests of dried mascara.

For this embodiment to be put into practice at a low cost and in a simple way in terms of injection technology, it is provided that the cover section has recesses on both sides of the handling section, these recesses enabling a mold slide to be withdrawn prior to the injection of the closing cap so that easy removal from the mold is ensured.

This technique of removal from the mold also ensures that two opposite naps can be disposed on the inside of the closing cap, the naps engaging with slide-lock-type guides on the outer wall of the neck, along which they are guided. As a result of this closing technique, opening and closing can be carried out rapidly, there being no need of changing the hold; therefore, this closing technique is of special advantage in connection with the flat handling section mentioned above.

Preferably, the slide-lock-type guides are formed by two sections opposing each other by 180°, each guide comprising a slope leading from the upper edge of the neck downwards and a rear recess for effective locking, and the two sections passing into each other via approximately triangular tips seen in an unwound view. This helps attain that a defined stop position is obtained upon unscrewing regardless of the position in which the user places the closing cap on the receptacle relative to the basic body thereof In another embodiment the connection by locking engagement takes place in a portion inside the receptacle below the neck and the stripper. Instead of a connection by locking engagement, provision may also be made for a connection by plug-in, clamping, press-fit or snap-in engagement or by a screw thread.

By alternative, the area of connection constituted by the locking engagement or some other type of connection may be disposed within the receptacle, above the stripper lip or precisely on the stripper lip.

The joint may have a diameter corresponding to the diameter of the rod. The diameter of the drilled hole or the free passage of the stripper lips can be smaller than the diameter of the rod, and the joint can have a correspondingly reduced diameter so that the stripper lips adjoin stressfree in the closed condition.

By advantage, the rod has a longitudinal recess with a locking groove and a rod holder of axial extension is fixed in the closing cap, a locking projection with a locking bead being formed on the free end, projecting into the receptacle, of the rod holder. A simple and safe connection can be put into practice in this way too.

In another embodiment it is provided that a rod holder is disposed in the closing cap, having a retaining sleeve which extends axially through the stripper and into which the rod of the applicator can be inserted. In this case again, locking engagement or insertion only by positive fit are conceivable.

Finally, it can be provided that the closing cap has a cylindrical or approximately conical handling section, which is open upwards and extends upwardly away from the cover section, and that an attachment for the rod extends downwards from the cover section integrally therewith. This design helps obtain an attractive appearance on the one hand and on the other hand a production in a single piece and at a low cost which can be realized by injection technology.

Details of the invention will become apparent from the ensuing description of preferred exemplary embodiments, taken in conjunction with the drawing.

DESCRIPTION OF THE PREFERRED EMBODIMENTS

Figure 1:
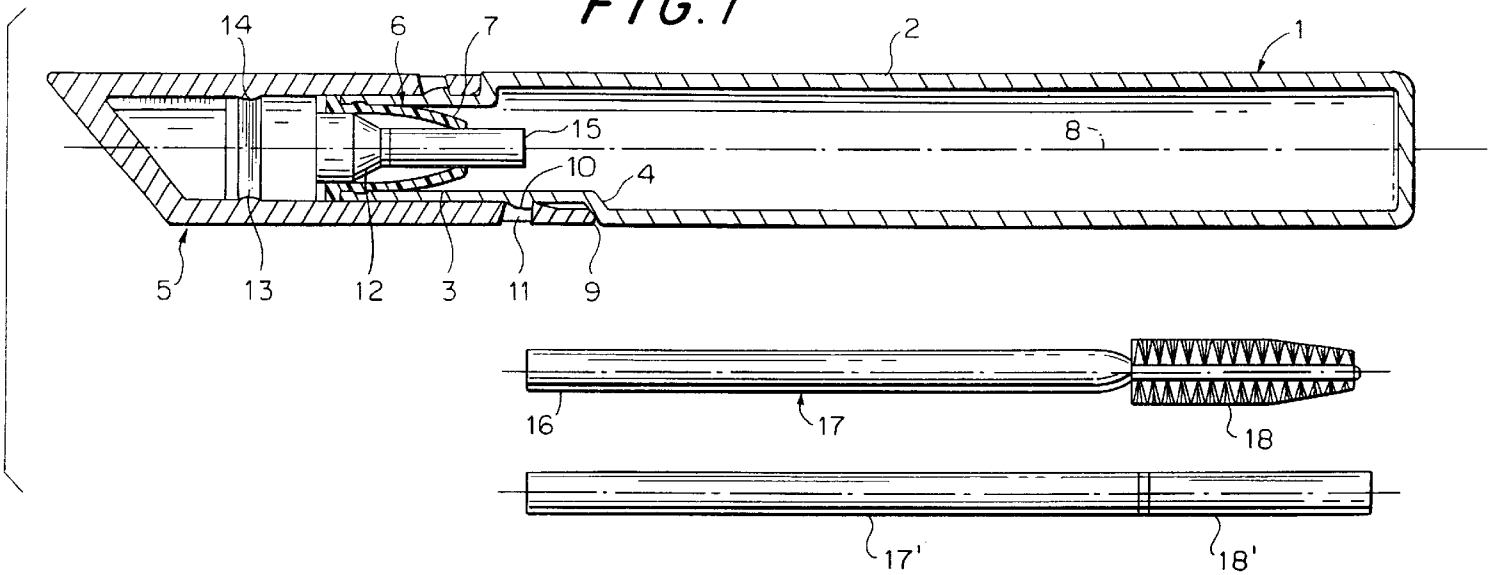
FIGS. 1 to 5 are longitudinal sections through varying embodiments of a mascara unit according to the invention.

A mascara unit according to the invention comprises a receptacle 1 having a basic body 2 and a neck 3 tapered as compared to the basic body 2, the basic body passing into the neck 3 via an encircling collar 4. A closing cap 5 is placed on the neck 3 to be in alignment with the outer wall of the basic body 2. A stripper 6 having stripper lips 7 is disposed inside the neck 3.

In the embodiment seen in FIG. 1, the collar 4 is inclined relative to the longitudinal axis 8 of the container 1 and so is the lower edge 9 of the closing cap 5.

Two opposed locking projections 10 are formed on the neck 3; they snapengage with locking recesses 11 in the form of openings of the closing cap 5 when the closing cap 5 is placed on correctly.

Inside the closing cap 5, a rod holder 12 is fixed on the inside wall of the closing cap 5 by way of a locking groove 13 and a corresponding locking bead 14. The rod holder 12 comprises a rod holder 15, in which the outer end 16 of the rod 17 can be locked into place by conventional means, the rod 17 being provided with an applicator in the form of a mascara brush 18. The rod holder 15 of the rod holder 12 extends beyond the stripper lips 7 of the stripper 6 into the inside of the receptacle 1. As shown in FIG. 1, rod holder 12 abuts against stripper 6 to seal receptacle 1 without rod 17 engaged to closing cap 5.

Figure 2:
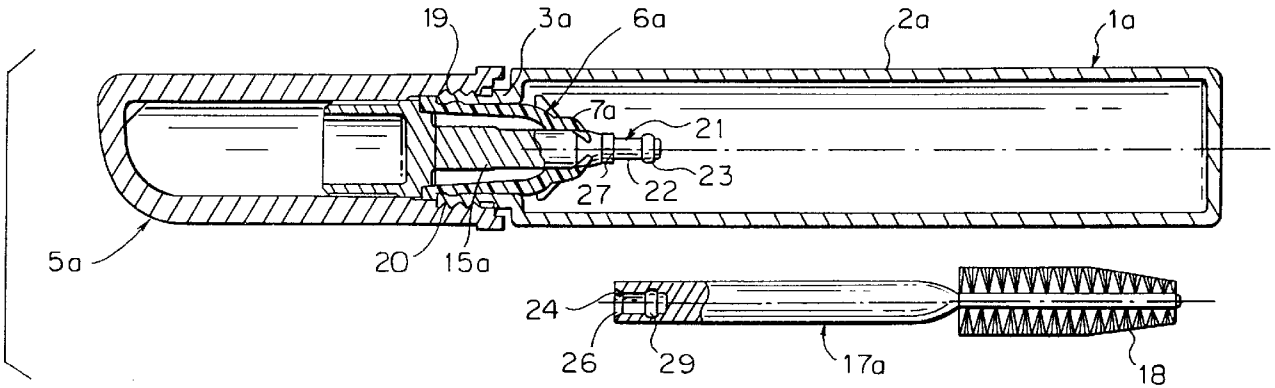

In the embodiment seen in FIG. 2, a rod holder 15*a* is again fixed in a closing cap 5*a*, which is screwed via a threaded section 19 on an external thread 20 on the neck 3*a* of the basic body 2*a*. An attachment 21 extends beyond the stripper lips 7*a* of the stripper 6*a* into the receptacle 1*a* and comprises a section 22 of a reduced outside diameter having an annular bead 23, on which the rod 17*a*, which has a drilled hole 24, can be snapped in such a way that an annular groove 29 of the drilled hole 24 snaps on the annular bead 23, the front 26 of the rod 17*a* coming to bear against the annular collar 27 of the rod holder 15*a*.

Figure 3:
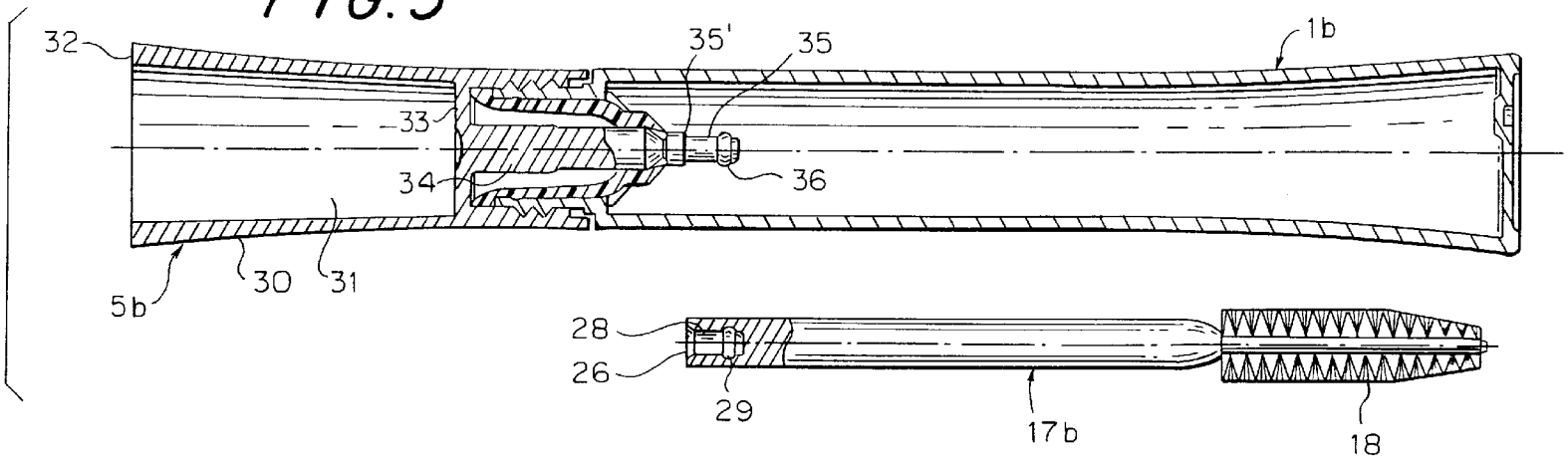

In the embodiment seen in FIG. 3, the mascara brush 18 is embodied in accordance with the exemplary embodiment of FIG. 2, comprising the rod 17*b*, the recess 28 and the annular groove 29.

The receptacle 1*b* and the cap 5*b* have a concave contour.

The cap 5*b* comprises a handling section 30, which has a cavity 31 and an end 32 open upwards (on the left in FIG. 3). A cover section 33 forms one piece with the handling section 30, a rod holder 34 forming a single piece with the cover section 33 and extending away from the inside thereof. The rod holder 34 has a tapered section 35 and stop 35, and an encircling locking bead 36 as in the embodiment according to FIG. 2.

Figure 4:
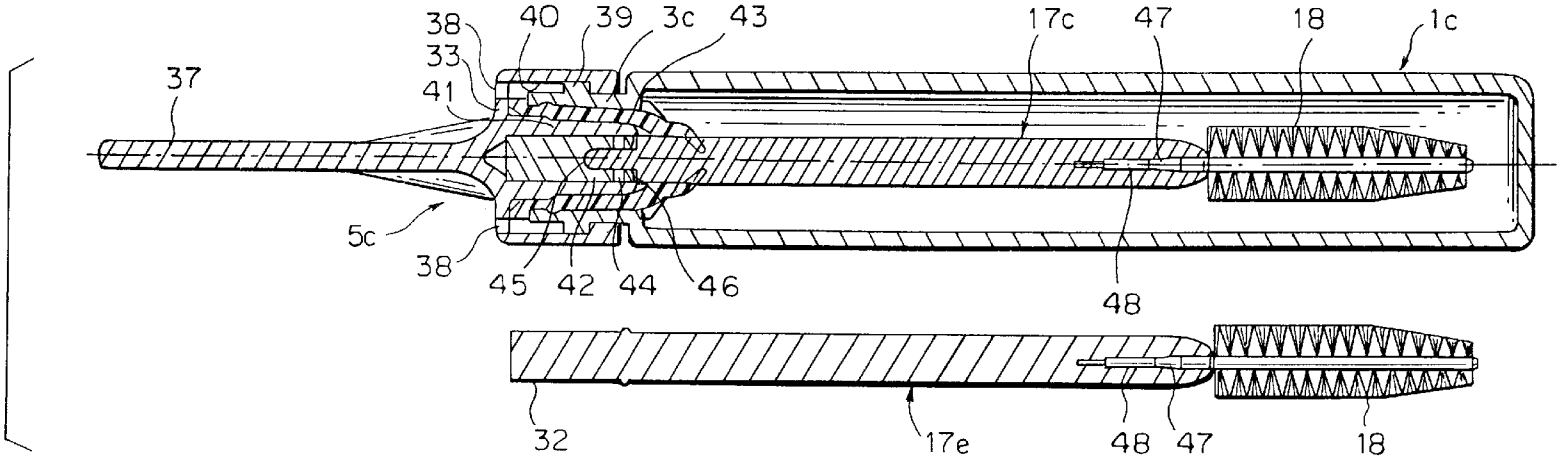

In the embodiment seen in FIG. 4, the closing cap 5*c* comprises a handling section 37, which is flat and extends outwards from a cover section 33. The cover section 33 has two openings 38 on both sides of the handling section 37, which ensure the insertion and withdrawal of slides in the injection mold, whereby naps 39 can be formed on the outside wall of the neck 3*c*, which cooperate with a slide-lock-type configuration on the inside wall 40 of the closing cap 5*c*. In this way it is possible by injection-molding technique to form a retaining sleeve 41 which extends inwards from the cover section 33. Either the end 32 of the rod 17*e* or a holding section 42 can be inserted directly into the sleeve 41, the holding section 42 comprising a recess 43 and a locking groove 44, in which a locking bead 46 of a tapered section 45 of the rod 17*c* can snap-engage.

The mascara brush 18 has a stepped piece 47 joined on, which can be inserted into a recess 48 of corresponding shape of the rod 17*c* 17*d*, 17*e*.

Figure 5:
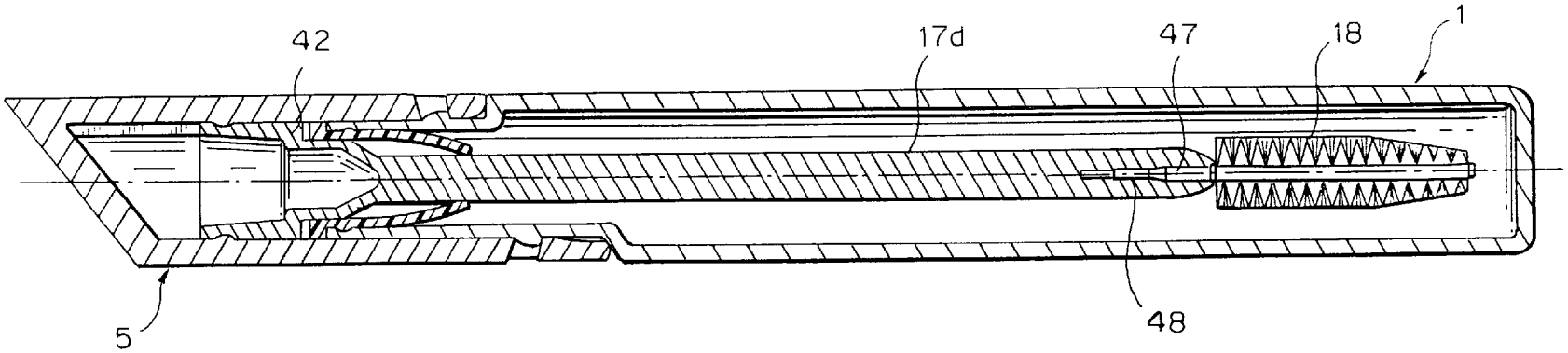

The embodiment according to FIG. 5 substantially corresponds to that according to FIG. 1, the holding section 42 passing integrally into the rod 17*d* and the mascara brush 18 selected by a client being fixable by insertion of the stepped piece 47 into the recess 48 as in the embodiment according to FIG. 4.

As indicated in the summary of the invention above, an object of the invention is to enable a user to select an applicator out of a variety of applications which meets the user's needs. Accordingly, each of the embodiments above are intended to permit use of at least an additional rod with a different applicator, as shown in FIG. 1 for example, by rod 17' with a different applicator 18' engaged. Each of the additional rods of an embodiment is respectively releasably engageable to the rod holder of the embodiment to which it corresponds in the same manner as the initially described rod and applicator.

What is claimed is:

1. A cosmetic unit, comprising, a receptacle for liquid take-up, which has a basic body with a neck having a diameter smaller than that of the basic body;

a closing cap to be placed on the neck;

a rod holder fixed to the closing cap;

a first rod having an applicator at the first end thereof, the first rod being releasably engaged at a second end thereof to the rod holder;

a stripper fixed in the neck of the body permitting the rod holder to extend through the stripper so that the applicator is stripped upon withdrawal from the receptacle;

wherein the rod holder forms a closing and sealing device with the stripper sealing the receptacle when the applicator rod and applicator are not engaged thereto;

and at least a second rod with a different applicator releasably engagable on said rod holder, whereby said first rod and applicator and said second rod and different applicator may be interchangeably engaged to said rod holder.

2. A cosmetic unit according to claim 1, wherein the first rod is connectable to the rod holder in locking engagement.

3. A cosmetic unit according to claim 2, wherein the connection by locking engagement is formed in a portion inside the receptacle below the neck and below stripper lips of the stripper engaged in the neck of the body.

4. A cosmetic unit according to claim 3, wherein the first rod comprises a longitudinal recess with a locking groove; and wherein the rod holder which has an axial extension is fixed in the closing cap, an attachment with a locking bead being formed on a free end of the rod holder extending into the receptacle.

5. A cosmetic unit according to claim 3, wherein the rod holder is disposed in the closing cap and extends axially through the stripper into which the rod of the applicator is insertable.

6. A cosmetic unit according to claim 3, wherein the closing cap has a cylindrical handling section, which is open and extends upwards away from a cover section; and wherein the rod holder for the first rod extends downward from the cover section, forming a single piece therewith.

7. A cosmetic unit according to claim 2, wherein the rod holder extends from a cover section of the closing cap in a direction towards an inside of the receptacle and has a locking bead thereon, the first rod having a locking groove that snap engages onto the locking bead; and wherein the locking bead is formed on a section of the rod holder which has a diameter smaller than a diameter of the first rod, forming a stop collar for the first rod on the rod holder.

8. A cosmetic unit according to claim 1, wherein a flat handling section extends from a cover section of said closing cap centrically away from an inside of the receptacle.

9. A cosmetic unit according to claim 8, wherein the cover section has recesses on both sides of the handling section, which enable a mold slide to be withdrawn upon injection molding of the closing cap.

10. A cosmetic unit according to claim 8, wherein two opposed projections are disposed on an inside of the closing cap, which engage with, and are guided along, slide-lock-type guides on an outer wall of the closing cap.

* * * * *